United States Patent [19]

Albertsen et al.

[11] Patent Number: 4,549,524

[45] Date of Patent: Oct. 29, 1985

[54] CATALYTIC UNIT FOR BURNERS

[75] Inventors: Peter S. Albertsen, Warwick, R.I.; Thomas Miller, Moncure, N.C.

[73] Assignee: Nu-Tec Incorporated, East Greenwich, R.I.

[21] Appl. No.: 588,531

[22] Filed: Mar. 12, 1984

[51] Int. Cl.[4] ..... F23V 15/00; F23L 11/00

[52] U.S. Cl. ..... 126/289; 126/286; 126/77; 110/203; 422/177

[58] Field of Search ..... 126/77, 123, 285 R, 126/285 A, 288, 289, 286; 110/203, 210, 211; 422/177

[56] References Cited

U.S. PATENT DOCUMENTS

| | | | |
|---|---|---|---|
| 4,319,556 | 3/1982 | Schwartz et al. | 126/77 |
| 4,330,503 | 5/1982 | Allaire et al. | 126/285 R X |
| 4,373,507 | 2/1983 | Schwartz et al. | 126/289 |
| 4,422,437 | 12/1983 | Hirschey | 126/77 |
| 4,437,451 | 3/1984 | Wysong | 126/77 |
| 4,466,421 | 8/1984 | Dorsch et al. | 126/285 A |
| 4,476,852 | 10/1984 | Lee et al. | 126/289 |
| 4,494,525 | 1/1985 | Albertsen | 126/289 |

FOREIGN PATENT DOCUMENTS

| | | | |
|---|---|---|---|
| 0087878 | 9/1983 | European Pat. Off. | 126/123 |

*Primary Examiner*—Margaret A. Focarino

[57] ABSTRACT

Apparatus for supporting a catalytic converter for a burner including a housing having an opening for directing the exhaust gases to a catalyst region and a by-pass opening permitting the exhaust gases to by-pass the catalyst region, a baffle positioned over the catalyst region and having a groove formed in it and a tab extending from one end and adjacent to the groove, a closure movably mounted to open and close the by-pass opening, and a control rod slidably and pivotally mounted within the groove and having one end connected to the closure to open and close the by-pass opening by pivoting of the rod, the rod being lockably engageable by the tab by longitudinal displacement of the rod when in a pivotal position corresponding to closing of the by-pass opening, and having handle means extending from the other end for permitting pivoting and longitudinal displacement of the rod.

5 Claims, 4 Drawing Figures

FIG 3
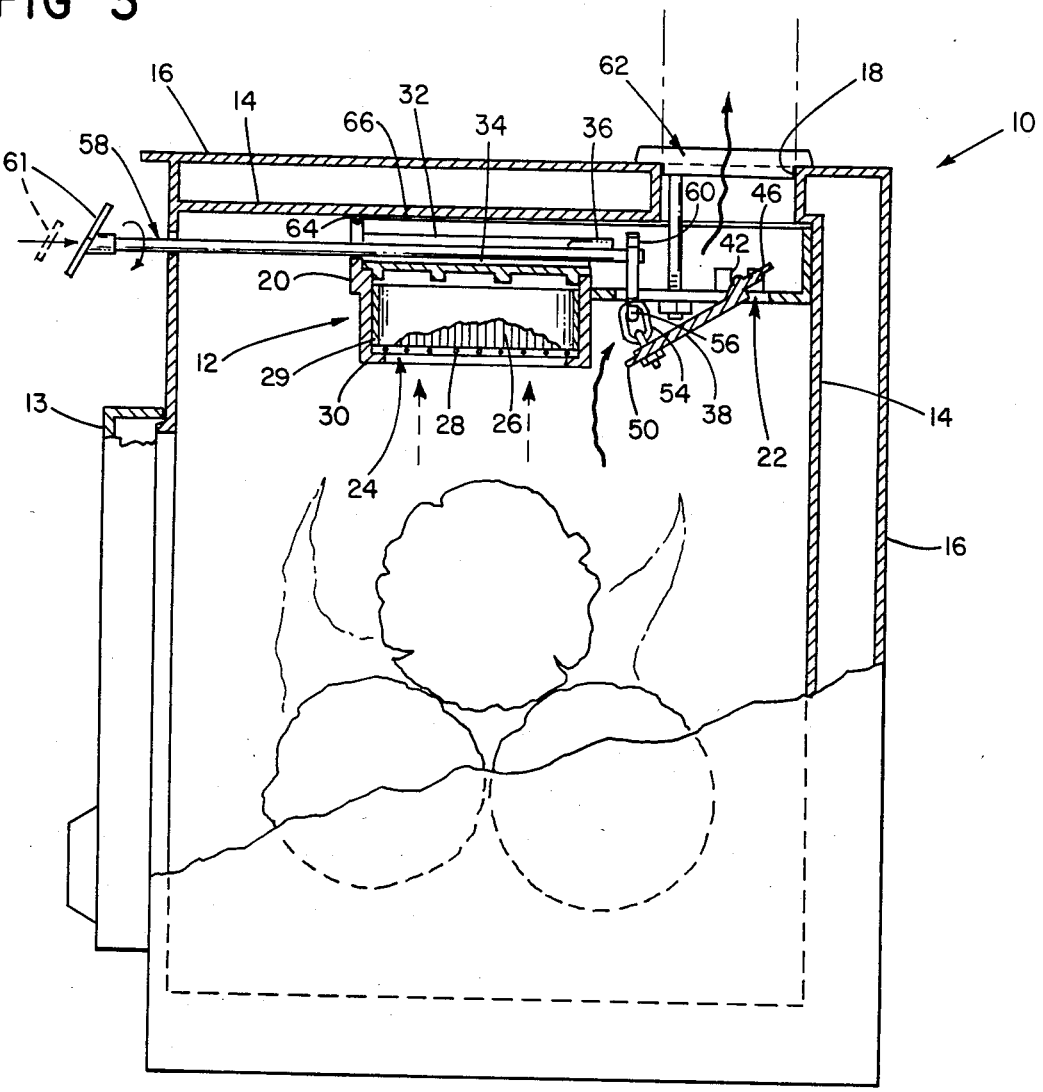
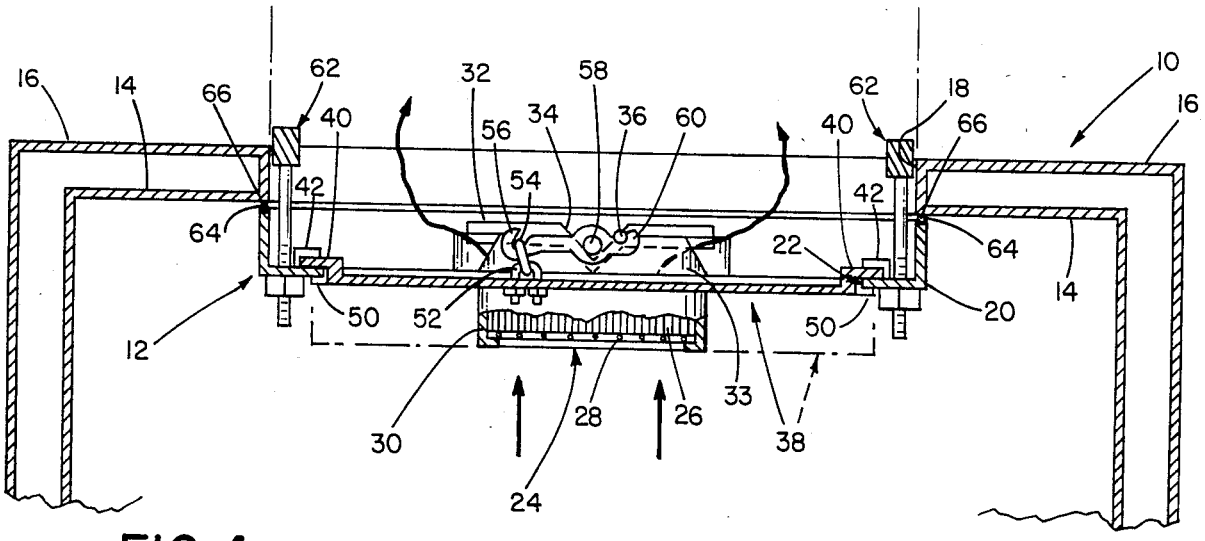
FIG 4

CATALYTIC UNIT FOR BURNERS

FIELD OF THE INVENTION

The invention relates to apparatus for supporting a catalytic converter for a burner.

BACKGROUND OF THE INVENTION

Burners such as wood burning stoves can be provided with catalytic converters to treat exhaust gases. It is desirable to also provide mechanisms to permit by-passing the converters, e.g., during starting of fires.

SUMMARY OF THE INVENTION

It has been discovered that a burner can be desirably provided with a catalytic converter and a by-pass mechanism by providing a housing having an opening to a catalyst region and a by-pass opening, a movable closure to open and close the by-pass opening, a baffle mounted over the catalyst region, and a control rod pivotally and slidably mounted in a groove formed in the baffle. The control rod is connected to the by-pass closure to open and close it by pivoting the rod, and can be locked to prevent pivoting when the closure is in a closed position by longitudinally displacing the rod to engage a tab on the baffle adjacent to the groove. The control rod extends from the housing a sufficient distance to permit it to extend from the burner, and the by-pass mechanism can be easily engaged outside of the burner by twisting and pushing or pulling on a handle on the rod. The apparatus is simple in construction and durable, making it reliable and reducing the risk of breakdown.

In preferred embodiments the control rod has a latch member with a hook on one end that engages the closure to the by-pass opening; the movable closure is a pivotal plate connected to the hook by a U-bolt; and the latch hook has a projection that engages the tab on the baffle.

DESCRIPTION OF THE PREFERRED EMBODIMENT

The structure and operation of the preferred embodiment of the invention will now be described after first briefly describing the drawings.

DRAWINGS

FIG. 3 is a sectional view, taken at 3—3 of FIG. 1, of the FIG. 1 apparatus mounted in the burner with its by-pass closure in an open position.

FIG. 4 is a sectional view, taken at 4—4 of FIG. 1, of the FIG. 1 apparatus mounted in the burner with its by-pass closure in a closed and locked position.

STRUCTURE

Figure 1:
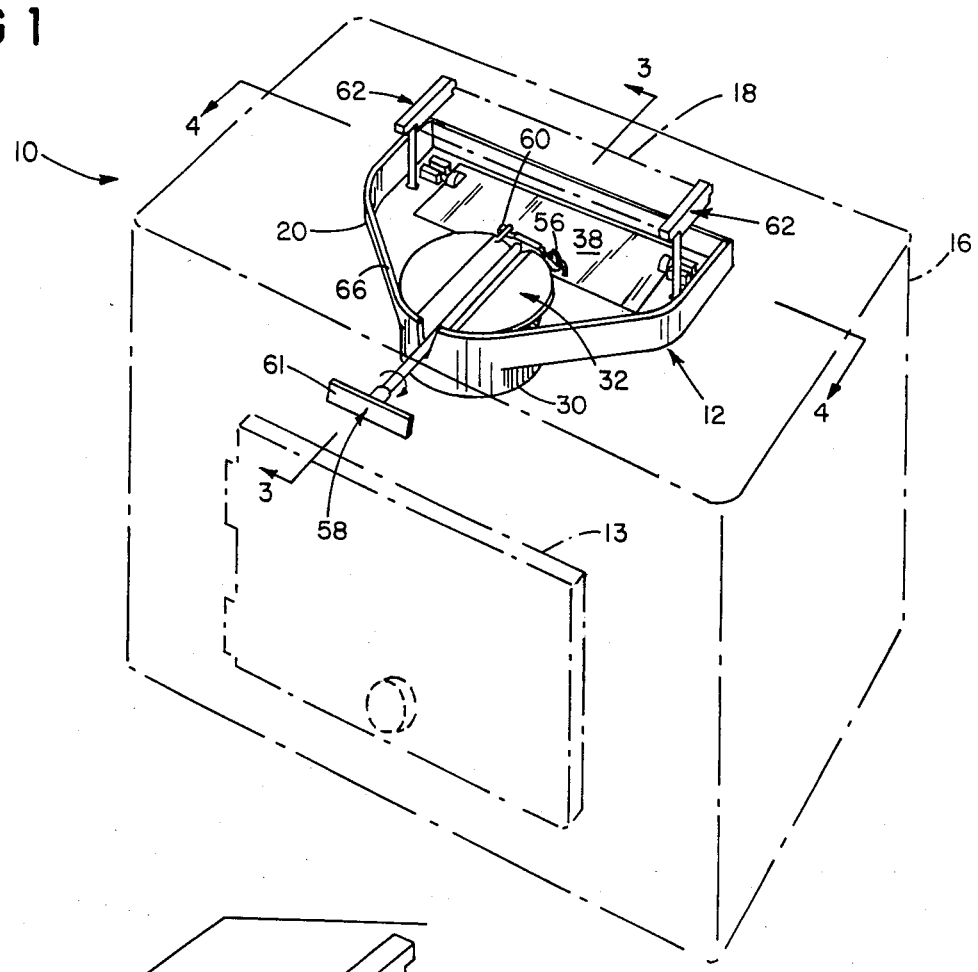
FIG. 1 is a perspective view of apparatus for supporting a catalytic converter according to the invention in a burner, shown in phantom.

Referring to the figures, there is shown wood burning stove 10 having catalytic converter supporting apparatus 12 mounted in an upper region. Stove 10 includes door 13, inner and outer walls 14, 16 and rectangular exhaust gas opening 18 through walls 14, 16 in the upper rear region of stove 10.

Catalytic converter supporting apparatus 12 includes housing 20 having by-pass opening 22 and opening 24 to catalytic converter 26, supported on screen 28, in turn supported by lip 30 surrounding opening 24. Wrapped around converter 26 is heat expanding gasket 29. Above catalytic converter 26 is baffle 32 having V-groove 34 in its central region and tab 36 extending from one end near an end of V-groove 34. Baffle 32 is supported on supports 33.

By-pass closure plate 38 has pins 40 extending from opposite sides and received between projections 42 of housing 20 for pivotally mounting plate 38 within opening 22. Rear portion 44 of plate 38 has edge portion 46 shaped to overlie the rear portion of housing 20 surrounding opening 22 when closed; front portion 48 of plate 38, in front of pins 40, similarly has edge portion 50 shaped to underlie the front portion of housing 20 surrounding opening 22. U-bolt 52 is fastened to portion 48 of plate 38. Chain link 54 through U-bolt 52 is engaged by a hook at one end of latch hook 56, which is connected to control rod 58 and has projection 60 for lockably engaging tab 36 at the other end. Control rod 58 is pivotally and slidably mounted in V-groove 34 of baffle 32. It extends from the front of housing 20 a sufficient distance to permit it to extend from stove 10 during use, and has handle 61 on the front end.

T-bolt hangers 62 extend upward from the inside of housing 20, and the front and rear edges of their upper portions extend over portions of outer wall 16 and hold apparatus 12 in place (FIG. 3). Three-sixteenth inch diameter sealing rope 66 sits within edge groove 64 of housing 20 to provide a seal between apparatus 12 and inner wall 14 of stove 10 during use.

Housing 20, baffle 32, by-pass closure plate 38, latch hook 56, handle 61 and T-bolt hangers 62 are all made of cast iron. Rod 58 is made of steel. Catalytic converter 26 is 5.4 inches in diameter and 1.5 inches in height, has 0.2 inch by 0.2 inch square cross-section passages from the bottom to the top provided between 0.02 inch to 0.025 inch thick walls and is made of Cordierite with a palladium based catalyst. Support screen 28 is made of stainless steel.

OPERATION

Figure 2:
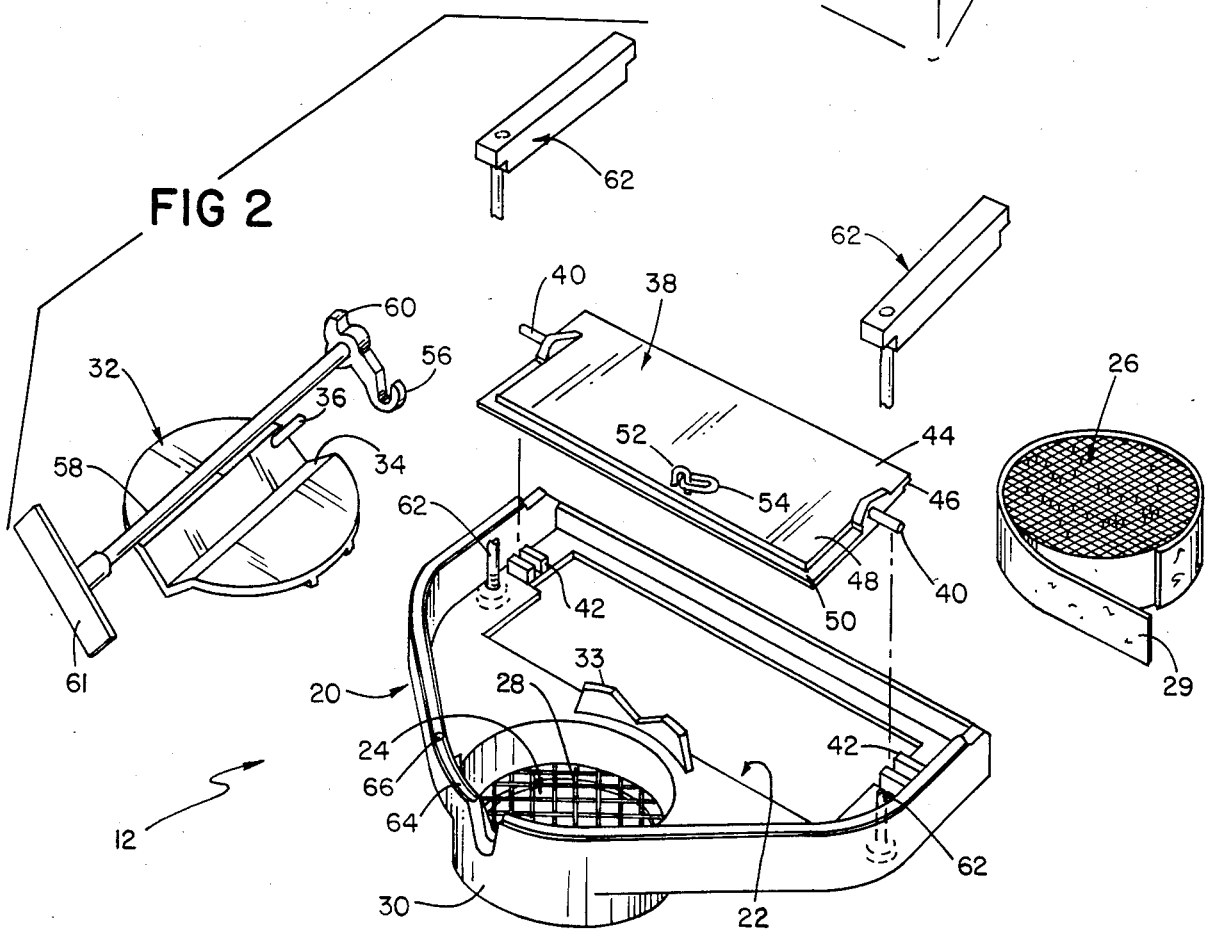
FIG. 2 is an exploded view of the FIG. 1 apparatus.

In use, the fire is started while by-pass closure plate 38 is in an open position (FIG. 3), causing the exhaust gases to by-pass catalytic converter 26 and to go through by-pass opening 22, because there is a very low resistance path through opening 22 compared to that through catalytic converter 26. Once the fire is burning well, and the chimney is heated so that a good draft is established, the exhaust gases are directed through catalyst 26 by closing by-pass closure plate 38. This is done by rotating handle 61 (and thus latch hook 56) counterclockwise from the position shown in FIG. 2 to the position shown in FIGS. 1 and 4, which raises the front of plate 38, and then pulling handle 61 outward to cause projection 60 to be underneath tab 36. This prevents control rod 58 and latch hook 56 from rotating and thus prevents closure plate 38 from opening. Overlying and underlying portions 46, 50 provide a good seal around by-pass opening 22, because the nuts on U-bolt 52 are adjusted during installation to provide the proper force on plate 38. Similarly, T-bolt hangers 62 have bolts on their bottom ends that are adjusted to provide the proper seal between housing 20 and inner wall 14.

When the exhaust gases are passing through catalytic converter 26, they are deflected sideways by baffle 32 and rearward to opening 18. This deflection prevents the walls of the stove above housing 20 from overheating.

To open closure plate 38, one merely pushes handle 61 in, and plate 38 opens by gravity.

OTHER EMBODIMENTS

Other embodiments of the invention are within the scope of the following claims.

What is claimed:

1. Apparatus for supporting a catalytic converter for a burner comprising a housing including means for mounting said housing in said burner in a position to receive exhaust gases of said burner, said means for mounting including a pair of hangers extending upwardly through an exhaust gas opening of said burner and having portions extending horizontally beyond said exhaust gas opening for hanging over the top of said burner, means for supporting a catalyst in a catalyst region, means for defining an opening for directing said exhaust gases to said catalyst region, and means for defining a by-pass opening permitting said exhaust gases to by-pass said cataylst region, a baffle positioned over said catalyst region and having a groove formed in it and a tab extending from one end and adjacent to said groove, a closure movably mounted to open and close said by-pass opening, and a control rod slidably and pivotally mounted within said groove and having one end connected to said closure to open and close said by-pass opening by pivoting and having means for lockably engaging said tab by longitudinal displacement of said rod when in a pivotal position corresponding to a closed position of said closure, and another end having handle means for permitting pivoting and longitudinal displacement of said rod.

2. The apparatus of claim 1 wherein said control rod has, connected to said one end, a latch member with a hook on one end that engages said closure.

3. The apparatus of claim 2 wherein said means for lockably engaging is a projection on the other end of said latch member from said hook.

4. The apparatus of claim 3 wherein said closure is a pivotal plate.

5. The apparatus of claim 4 wherein said pivotal plate is connected to said hook by a U-shaped bolt that is adjustable to provide proper tension in said bolt and sealing force on said pivotal plate.

* * * * *